US007438195B2

(12) United States Patent
Beck

(10) Patent No.: US 7,438,195 B2
(45) **Date of Patent: *Oct. 21, 2008**

(54) ALL-TERRAIN VEHICLE SHIPPING PACKAGE

(75) Inventor: Mark J. Beck, Anderson, SC (US)

(73) Assignees: Tech-Source, Inc., Anderson, SC (US); Wright Metal Products, Inc., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/640,153

(22) Filed: Dec. 15, 2006

(65) Prior Publication Data

US 2007/0095775 A1 May 3, 2007

Related U.S. Application Data

(63) Continuation of application No. 10/751,679, filed on Jan. 5, 2004, now Pat. No. 7,152,749, which is a continuation of application No. 09/961,800, filed on Sep. 24, 2001, now Pat. No. 7,097,054.

(51) Int. Cl.
*A47F 7/00* (2006.01)
*B65D 85/62* (2006.01)
*B65D 85/68* (2006.01)

(52) U.S. Cl. ..... 211/194; 211/85.8; 211/189; 206/335; 206/503

(58) Field of Classification Search ..... 211/194, 211/189, 85.8; 410/2–4, 23; 206/335, 509, 206/511, 512, 386, 600, 485, 503, 428, 668; 108/55.1, 56.3

See application file for complete search history.

(56) References Cited

U.S. PATENT DOCUMENTS 982,046 A 1/1911 Flemming (Continued)

FOREIGN PATENT DOCUMENTS

FR 2639038 5/1990

(Continued)

OTHER PUBLICATIONS

First Supplemental Responses by Yamaha Motor Manufacturing Corporation of America to Plaintiffs' First Interrogatories, filed in Case No. 5-CP-04-1492, State of South Carolina Court of Common Pleas, Dec. 23, 2005.

(Continued)

*Primary Examiner*—Jennifer E. Novosad
(74) *Attorney, Agent, or Firm*—Nelson Mullins Riley & Scarborough LLP

(57) ABSTRACT

A shipping container for a motorized vehicle comprises a base frame and a top frame, each constructed of rigid tubing. The base frame has a plurality of tire rests on which respective wheels of the motorized vehicle will be placed. In addition, the base frame has a plurality of base sockets located at respective corners thereof. Each of the base sockets is oriented in an upward direction. The top frame of the shipping container includes a plurality of top sockets located at respective corners thereof. The top sockets are oriented in a downward direction so as to be opposed to the base sockets. A plurality of elongate posts respectively extend between each opposed pair of sockets such that the top frame will be supported in spaced apart relation from the base frame.

13 Claims, 8 Drawing Sheets

U.S. PATENT DOCUMENTS

| | | | |
|---|---|---|---|
| 2,557,105 | A | 6/1951 | Hight |
| 2,579,685 | A | 12/1951 | Loose |
| 2,594,287 | A | 4/1952 | Budd |
| 3,147,860 | A | 9/1964 | Kean, Sr. et al. |
| 3,195,481 | A | 7/1965 | Verguin |
| 3,327,654 | A | 6/1967 | Duncan et al. |
| 3,499,398 | A | 3/1970 | Murray |
| 3,583,581 | A | 6/1971 | Myers |
| 3,709,163 | A | 1/1973 | Smedley et al. |
| 3,762,343 | A | 10/1973 | Thacker |
| 3,809,234 | A | 5/1974 | Kurick |
| 3,848,747 | A | 11/1974 | Thompson |
| 3,850,295 | A | 11/1974 | Black |
| 3,938,660 | A | 2/1976 | Moehring |
| 4,339,047 | A | 7/1982 | Johansson et al. |
| 4,703,702 | A | 11/1987 | Speicher |
| 4,756,413 | A | 7/1988 | Gits |
| 4,773,547 | A | 9/1988 | Bell |
| 4,804,087 | A | 2/1989 | Smith |
| 4,852,756 | A | 8/1989 | Holladay |
| 4,852,779 | A | 8/1989 | Berg |
| 4,924,783 | A | 5/1990 | Weizer et al. |
| 4,938,350 | A | 7/1990 | Grigsby |
| 5,143,283 | A | 9/1992 | Lancaster |
| 5,154,286 | A | 10/1992 | Gits |
| 5,413,224 | A | 5/1995 | Marron et al. |
| 5,489,171 | A | 2/1996 | Claps et al. |
| 5,593,058 | A | 1/1997 | Spencer et al. |
| 5,593,259 | A | 1/1997 | Kuo |
| 5,626,231 | A | 5/1997 | Kwong et al. |
| 5,671,854 | A | 9/1997 | Thomas |
| 5,720,403 | A | 2/1998 | Sawyer |
| 5,743,421 | A | 4/1998 | Gonzalez et al. |
| 6,186,345 | B1 | 2/2001 | Robertson |
| 6,202,569 | B1 | 3/2001 | Bailey et al. |
| 6,270,007 | B1 | 8/2001 | Jensen, Jr. |
| 6,286,792 | B1 | 9/2001 | Best |
| 6,726,041 | B2 | 4/2004 | Dunn |
| 7,152,749 | B2 * | 12/2006 | Beck ..... 211/194 |

FOREIGN PATENT DOCUMENTS

| | | |
|---|---|---|
| JP | 01143148 | 6/1989 |
| JP | 11147532 | 6/1999 |
| JP | 2000190967 | 7/2000 |

OTHER PUBLICATIONS

Yamaha's Disclosure of Invalidity Contentions, filed in Case No. 6:05-cv-01202-WMC, U.S. District Court for the District of South Carolina Greenville Division, Jan. 11, 2006 (lawsuit involved alleged infringement of U.S. Pat. No. 6,726,041).

* cited by examiner

ALL-TERRAIN VEHICLE SHIPPING PACKAGE

CROSS REFERENCE TO RELATED APPLICATION

This application is a continuation of application Ser. No. 10/751,679, filed Jan. 5, 2004, now U.S. Pat. No. 7,152,749, which is a continuation of application Ser. No. 09/961,800, filed Sep. 24, 2001, now U.S. Pat. No. 7,097,054. The foregoing patent applications are incorporated herein by reference.

BACKGROUND OF THE INVENTION

The present invention relates to the manufacture and distribution of all-terrain vehicles (ATVs). More particularly, the invention relates to improvements in the manner in which ATVs are packaged for shipment.

In the past, ATVs have typically been packaged for shipment in wooden and cardboard crates that are individually constructed at the factory. While generally providing an effective shipping container, these crates introduce a number of problems into the distribution process. For example, experienced workers are required to assemble the crates as the ATVs come off the production line. Often, construction of the crates can produce airborne particles (such as sawdust) that are undesirable in a facility where the ATVs may be painted. The ATV manufacturers are also required to maintain a significant supply of wood in inventory. In addition, the wooden crates are generally unsuitable for stacking and limit accessibility to the ATV for rework that may occasionally be required. Wood and cardboard is also generally unacceptable for transport to many foreign countries because it can result in bug and beetle infestation.

A wooden crate also creates various difficulties at the destination (typically a retail dealer of ATVs and similar equipment). Various tools, such as pry bars, hammers and saws, have often been required to remove the ATV from the crate. The broken planks and various other pieces that result from disassembling the crate are generally considered to be waste that must be discarded.

SUMMARY OF THE INVENTION

The present invention recognizes and addresses the foregoing considerations, and others, of prior art constructions and methods.

According to one aspect, the present invention provides a shipping container for a motorized vehicle having a plurality of wheels. The shipping container comprises a base frame and a top frame, each constructed of rigid tubing. The base frame has a plurality of tire rests on which respective wheels of the motorized vehicle will be placed. In addition, the base frame has a plurality of base sockets located at respective corners thereof. Each of the base sockets is oriented in an upward direction.

The top frame of the shipping container includes a plurality of top sockets located at respective corners thereof. The top sockets are oriented in a downward direction so as to be opposed to the base sockets. A plurality of elongate posts respectively extend between each opposed pair of sockets such that the top frame will be supported in spaced apart relation from the base frame.

In some exemplary embodiments, the base frame includes a plurality of first mating elements respectively located at bottom corners thereof. The top frame in such embodiments will include a plurality of second mating elements respectively located at top corners thereof. The first and second mating elements are configured to facilitate stacking of the shipping container with similar others.

Each of the first mating elements may comprise a recess element and each of the second mating elements may comprise a nub element. The nub element is received in the recess element so as to allow stacking of the shipping container. For example, the recess element may be formed by a respective flared cap respectively located at the bottom of each base socket.

Often, the base frame of the shipping container will be constructed having a first base side rail extending between a first base socket and a second base socket. In such embodiments, a second base side rail extends between a third base socket and a fourth base socket. A first base end rail extends between the first base socket and the fourth base socket. A second base end rail extends between the second base socket and the third base socket.

In many embodiments, the base frame may further comprise first and second inside base rails extending between the first and second end rails. The inside base rails are located in parallel with and laterally inward of the side rails. Often, the tire rests in such embodiments may comprise a tire plate extending between one of the side base rails and an adjacent inside base rails.

The top frame may be configured having a first top side rail extending between a first top socket and a second top socket. In such embodiments, a second top side rail extends between a third top socket and a fourth top socket. A first top end rail extends between the first top socket and the fourth top socket. A second top end rail extends between the second top socket and the third top socket.

Other aspects of the present invention are achieved by a combination comprising a motorized vehicle having a plurality of wheels and a shipping container in which the motorized vehicle is securely located. The shipping container has a rectangular base frame and a rectangular top frame interconnected by elongate posts so as to be in spaced apart relation. First mating elements are located at respective bottom corners of the rectangular base frame. In addition, second mating elements are located at respective top corners of the top frame. The first and second mating elements are configured to facilitate stacking of the shipping container with similar others.

In some exemplary embodiments, respective ends of each elongate post are removably received in opposed first and second sockets respectively located on the base frame and the top frame. At least one retaining band preferably extends about the shipping container in such embodiments. In addition, the motorized vehicle may be secured to the base frame of the shipping container via flexible straps connected to a vehicle frame thereof. Toward this end, the base frame may include a plurality of attachment tubes in which respective eye bolts are located, the flexible straps being attached to the eye bolts.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying drawings, in which.

Figure 1:
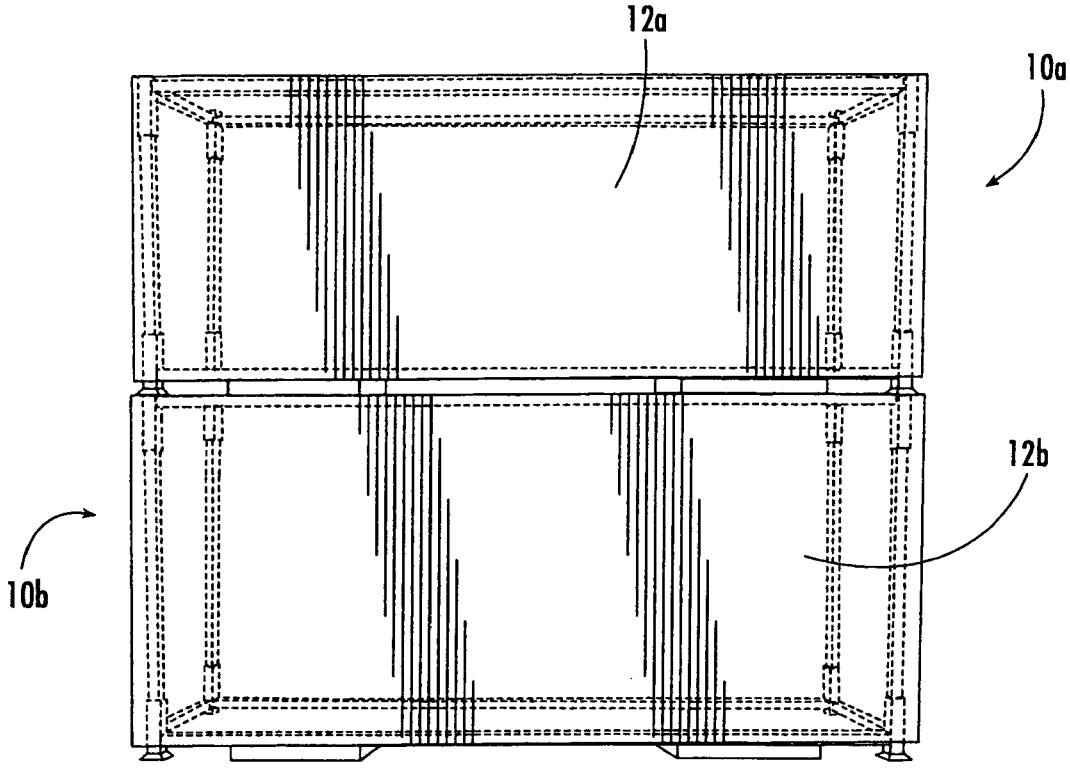
FIG. 1 shows a pair of stacked shipping containers constructed in accordance with the present invention with container covers in place.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention.

FIG. 1 illustrates a pair of shipping containers constructed in accordance with the present invention. As shown, shipping containers 10*a-b* are adapted to be stacked one upon another for shipment or storage. In this case, each of the shipping containers is equipped with a respective protective cover 12*a-b*. Preferably, protective covers 12*a-b* will be made of a suitable waterproof web material, which advantageously permits the packaged ATVs to be stored outside until ready for shipment.

Figure 2:
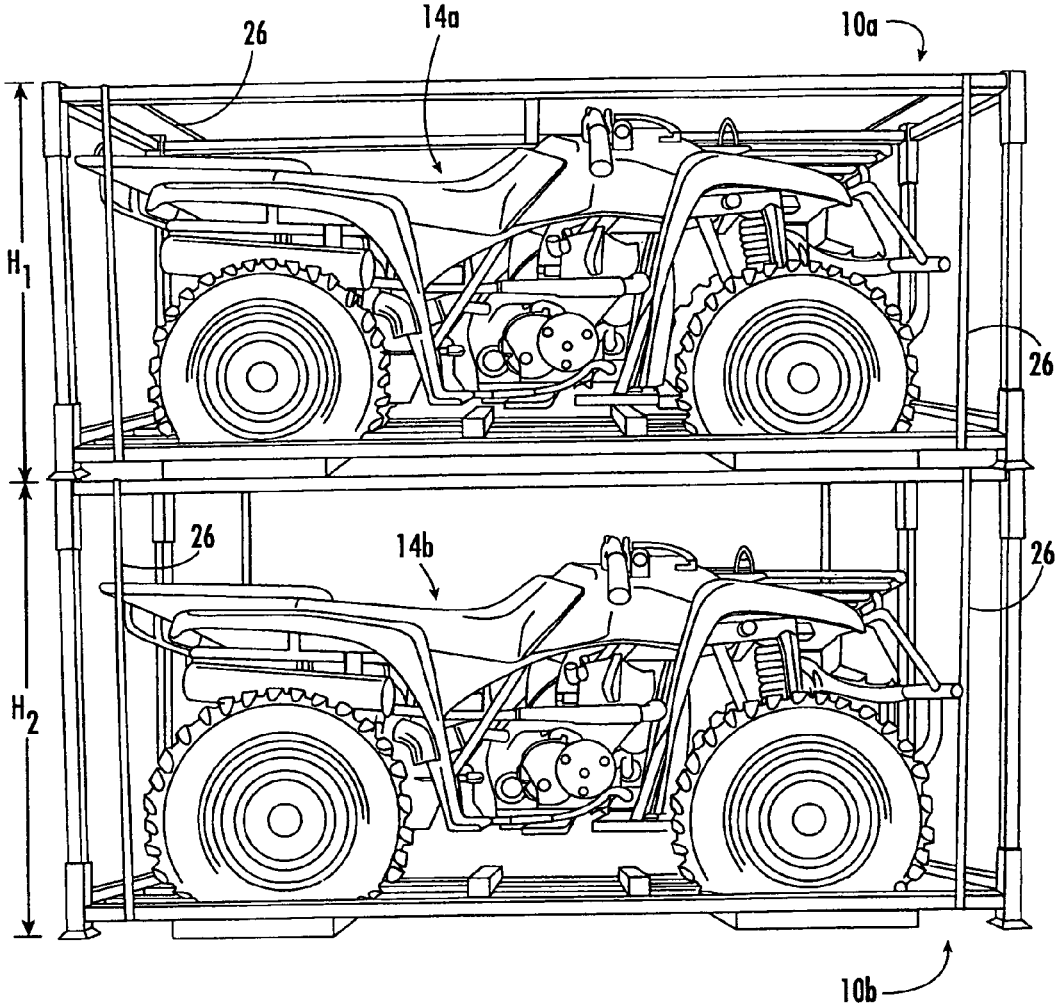
FIG. 2 shows the stacked shipping containers of FIG. 1 uncovered to show ATVs located therein.

Referring now to FIG. 2, shipping containers 10*a-b* are shown with the protective covers removed. As can be seen, a respective ATV 14*a-b* is located in each of the shipping containers 10*a-b*. As will be explained more fully below, ATVs 14*a-b* are secured to the respective shipping container so as to be substantially immovable during the shipment process.

In this case, it can be seen that shipping container 10*a* has a vertical height $H_1$ which is less than the vertical height $H_2$ of shipping container 10*b*. The design of the present invention permits changes in vertical height of the shipping container by substitution of corner posts. In this manner, a variety of different ATVs having a similar "footprint" can be accommodated without requiring a completely different shipping container for each.

Figure 3:
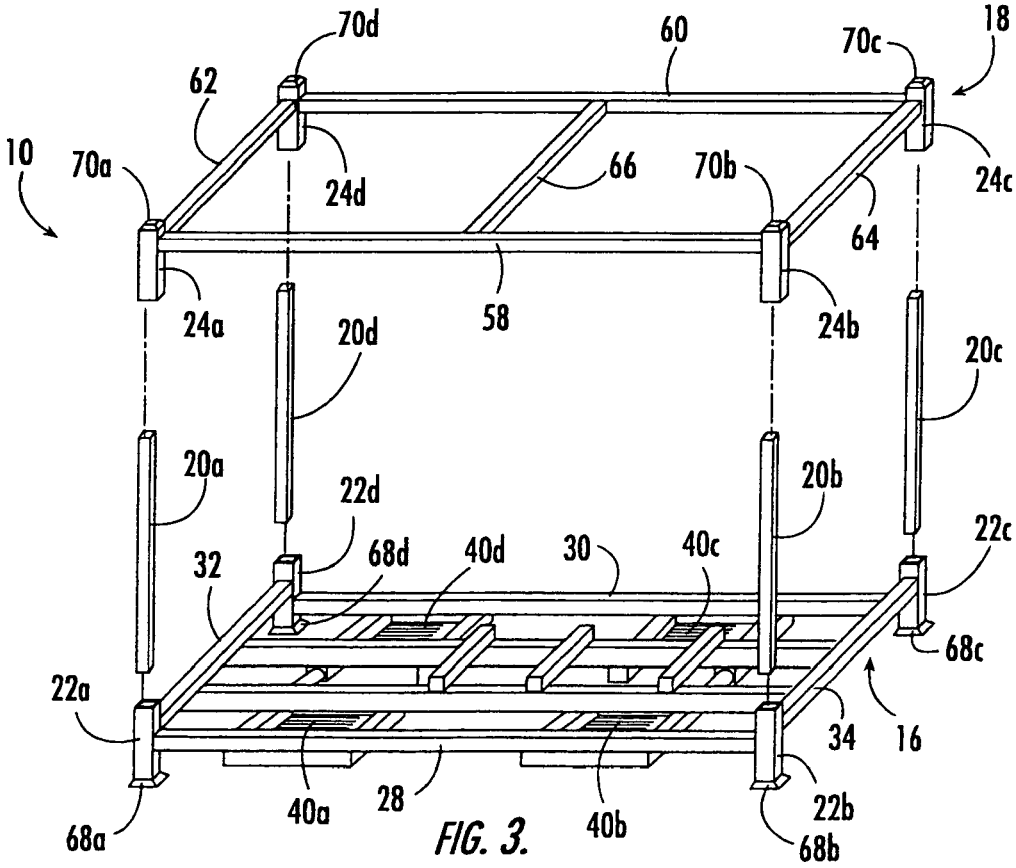
FIG. 3 is an exploded perspective view of a shipping container constructed in accordance with the present invention.

Referring now to FIG. 3, shipping container 10 includes a base frame 16 and a top frame 18 maintained in spaced apart relation by corner posts 20*a-d*. One end of each corner post 20*a-d* is received in a corresponding base socket 22*a-d* located at respective corners of base frame 16. The other end of each corner post 20*a-d* is received in an opposed top socket 24*a-d* located at respective corners of top frame 18. In this manner, top frame 18 will be maintained in spaced apart relation with respect to base frame 16. As noted above, the spacing between base frame 16 and top frame 18 can be easily adjusted by corner posts of a different length.

Preferably, suitable means are provided to maintain the various pieces of shipping container 10 together without permanent attachment. In this case, for example, a pair of retaining bands 26 are wrapped tautly around each shipping container. Retaining bands 26 may be conventional steel bands which can be easily cut when it is necessary to disassemble the shipping container for removal of the ATV therein. It will also be noted that the open design of the shipping container allows access to the ATV for rework without unpackaging.

Base frame 16, top frame 18 and corner posts 20*a-d* may preferably be made of a suitable mechanical steel, such as 16-gauge tubular steel or the like. The sockets may be easily formed as short sections of 1¾ inch 12-gauge tubular steel or similar suitable material. Preferably, the various tubular elements making up the racks are attached together by welding or other suitable means of attachment. This produces a durable construction which can more easily withstand vibration, impacts and the like than a wooden crate.

Figure 4:
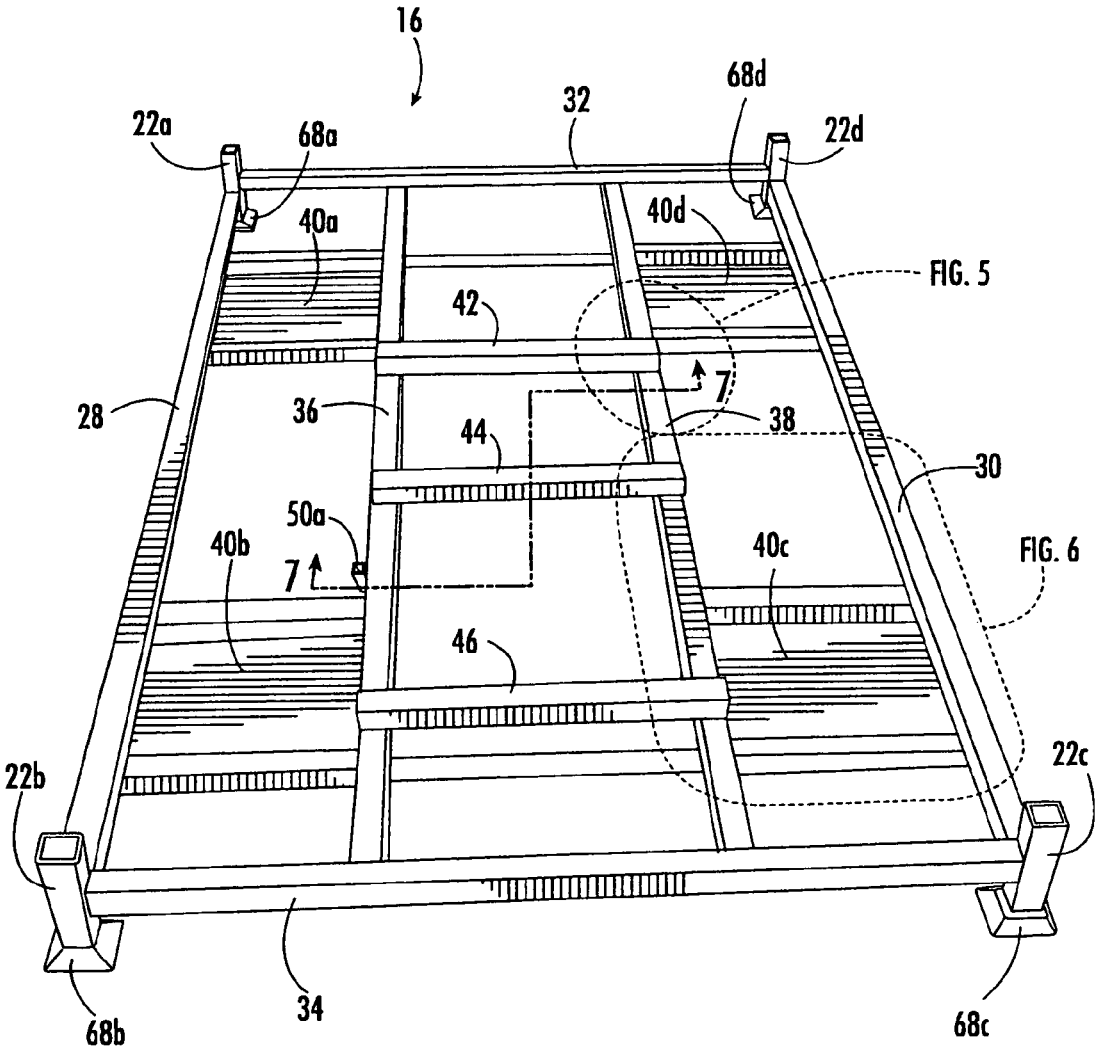
FIG. 4 is a perspective view of a base frame of the shipping container of FIG. 3.
Figure 5:
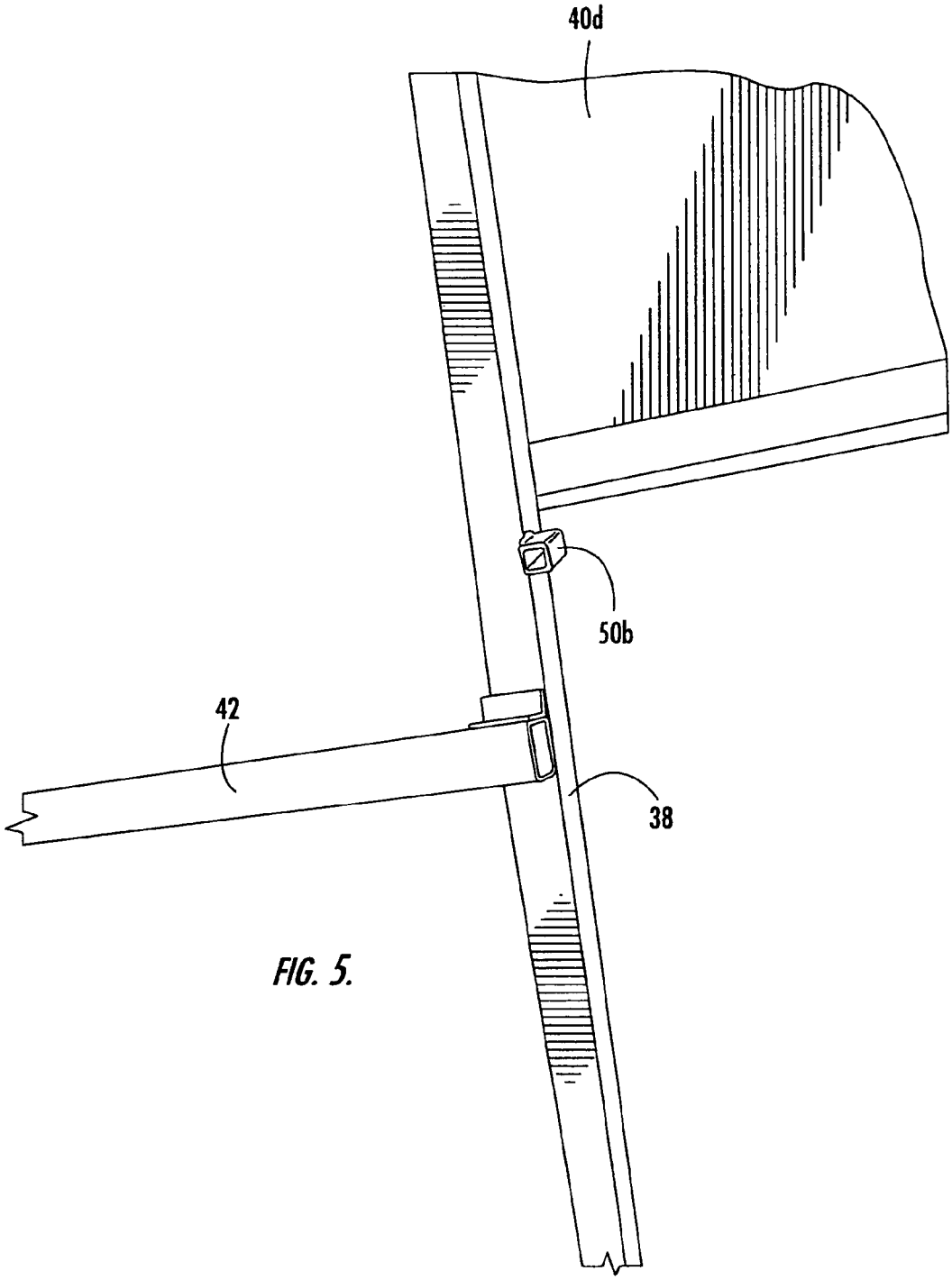
FIG. 5 is a view of the portion of the base frame so indicated in FIG. 4.
Figure 6:
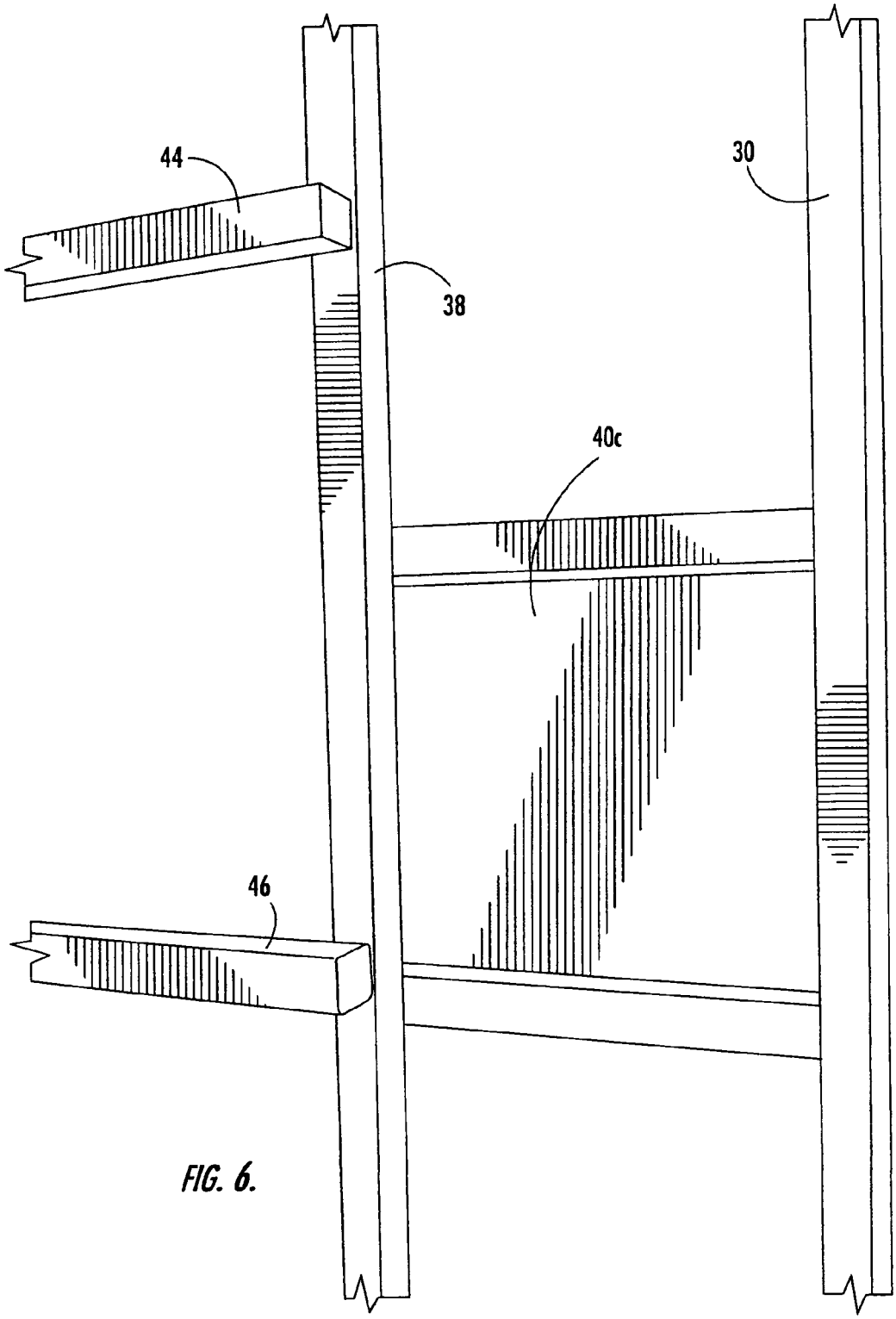
FIG. 6 is a view of the portion of the base frame so indicated in FIG. 4.

Referring now to FIGS. 4-6, the construction of base frame 16 will be described in greater detail. As can be seen, a first side rail 28 extends between base sockets 22*a* and 22*b*. A second side rail 30 similarly extends between sockets 22*c* and 22*d*. A first end rail 32 extends between sockets 22*a* and 22*d*. Similarly, a second end rail 34 extends between sockets 22*b* and 22*c*. A pair of inside rails 36 and 38 extend between end rails 32 and 34 so as to be in parallel with side rails 28 and 30.

Base frame 16 further includes a plurality of tire rests 40*a-d* on which respective wheels of the ATV will be located. In this case, each of the tire rests 40*a-d* may be formed by a plate extending between one of the side rails 28, 30 and its adjacent inside rail 36, 38. Cross supports, such as those indicated at 42, 44 and 46, may extend between the inside rails 36 and 38 to provide further rigidity to the overall structure.

Figure 7:
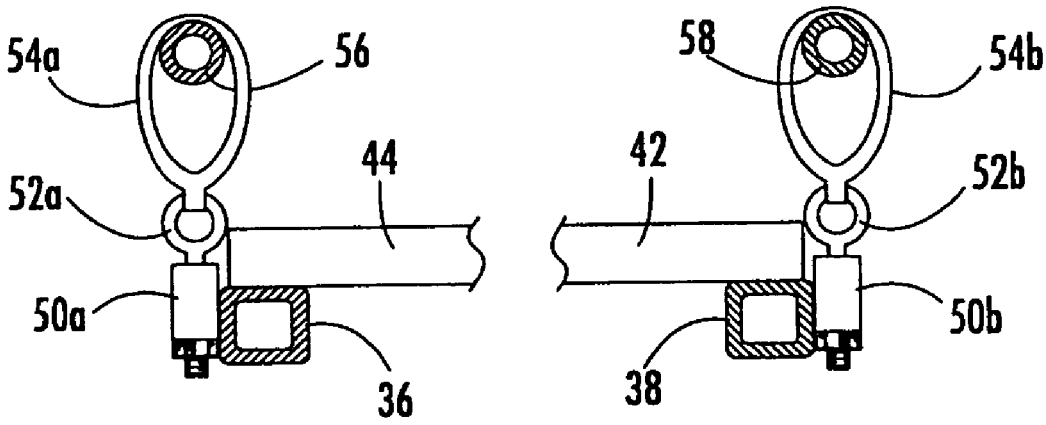
FIG. 7 is a view taken along line 7-7 of FIG. 4 showing the attachment tubes equipped with straps for securing the ATV.

Respective attachment tubes 50*a* and 50*b* may be located on the outboard side of rails 36 and 38, respectively. Referring now to FIG. 7, tubes 50*a* and 50*b* may be advantageously utilized to secure the ATV to base frame 16. Specifically, a respective eye-bolt 52*a-b* may be attached to base frame 16 at tubes 50*a-b*. Eye-bolts 52*a-b* may serve as a point of attachment for flexible straps 54*a-b*, which are in turn attached to a suitable element on the ATV's frame (as indicated at 56 and 58). Straps 54*a-b* are preferably made of a flexible material having the appropriate strength, such as 1⅜ inch woven polyester.

Figure 8:
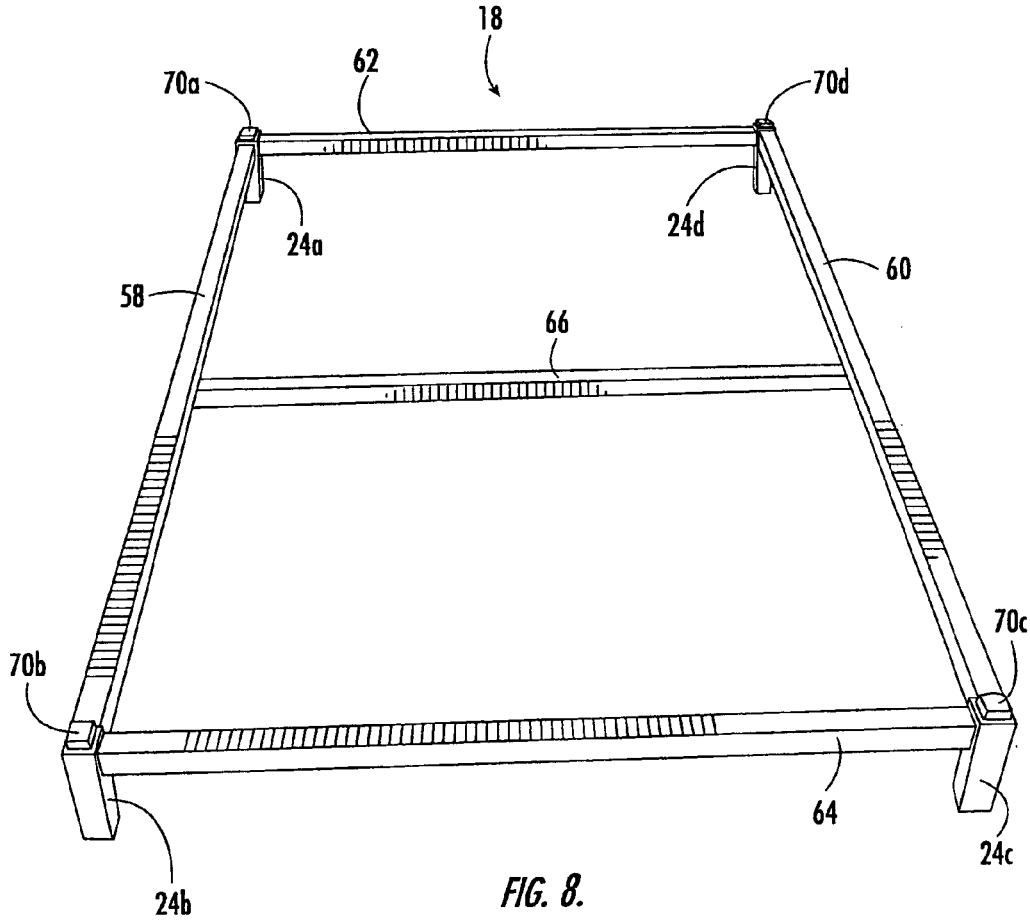
FIG. 8 is a perspective view of the top frame of the shipping container of FIG. 3.

Referring now to FIG. 8, it can be seen that top frame 18 includes a first side rail 58 extending between sockets 24*a* and 24*b*. A second side rail 60 similarly extends between sockets 24*c* and 24*d*. A first end rail 62 extends between sockets 24*a* and 24*d*. Likewise, a second end rail 64 extends between sockets 24*b* and 24*c*. A cross rail 66 extends between side rails 58 and 60, as shown.

Figure 9:
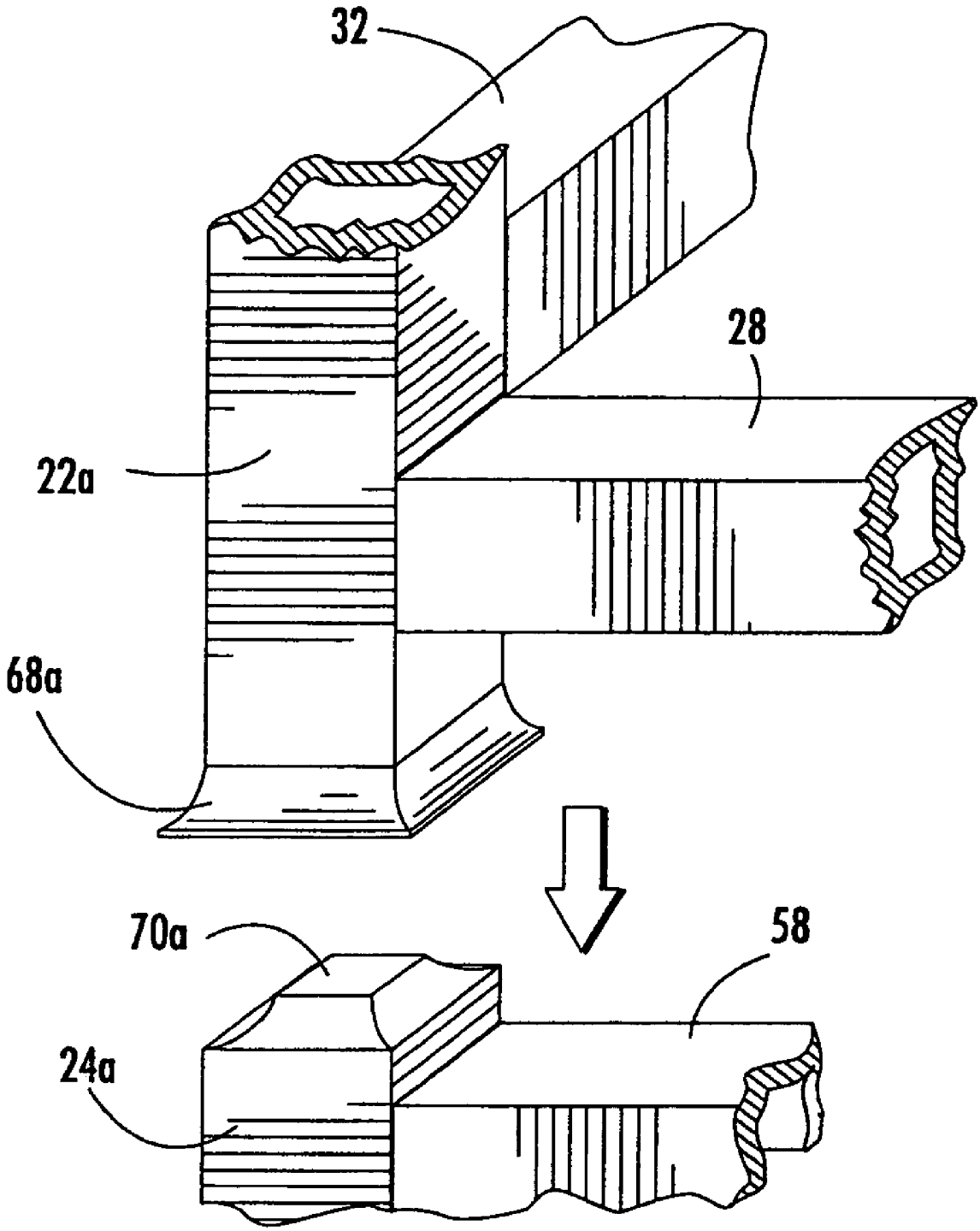
FIG. 9 is an enlarged view showing the manner in which a respective cap at the bottom of one shipping container mates with a nub element located at the top of another shipping container.

Referring again to FIG. 3, base frame 16 and top frame 18 are preferably equipped with complementary mating elements to allow stacking of multiple shipping containers. In the illustrated embodiment, base frame 16 includes a plurality of recess elements 68*a-d*, in this case formed by flared caps respectively located at the bottom of sockets 22*a-d*. Nub elements 70*a-d* are located atop respective sockets 24*a-d* of top frame 18. As can be most clearly seen in FIG. 9, the respective nub elements will be received in the corresponding cap when the units are stacked.

To assemble the shipping container, the ATV will be moved into position on base frame 16 with respective wheels being located on respective tire rests 40*a-d*. Corner posts 20*a-d* are then inserted into respective sockets 22*a-d*. Top frame 18 is brought into position over base frame 16, and the opposite ends of the corner posts are respectively inserted into sockets 24*a-d*. The ATV is secured to base frame 16 via straps 54*a-b*. Finally, retaining bands 26 are wrapped around shipping container 10 to maintain all of the pieces together for shipment.

It can be seen that the present invention provides an improved shipping container for a motorized vehicle which overcomes the disadvantages of a wooden crate. For example, the need to assemble complicated wooden crates at the production line is completely eliminated. Moreover, warehouse space requirements are reduced due to the racks being compact. There are no particles as may occur with wooden crates that could contaminate the paint line. Moreover, the possibility of damage to the ATV due to uncrating with hammers, pry bars, saws and the like is eliminated. In addition, the metal pieces of the shipping container may be easily reused or recycled.

While preferred embodiments of the invention have been shown and described, modifications and variations may be made thereto by those skilled in the art without departing from the spirit and scope of the present invention. Thus, it should be understood that aspects of various embodiments may be interchanged both in whole or in part. Furthermore, those of ordinary skill in the art will appreciate that the foregoing description is by way of example only, and is not intended to be limitative of the invention as further described in the appended claims.

What is claimed is:

1. A combination comprising:

an article for shipping;

a shipping container having a rectangular base frame constructed of rigid tubing and a rectangular top frame constructed of rigid tubing, said frames being interconnected by elongate posts so as to be in spaced apart relation, said article being located in and secured to said shipping container;

wherein respective ends of each said elongate post are removably connected by socket connections to said base frame and said top frame, respectively;

a plurality of first mating elements located at respective bottom corners of said rectangular base frame; and a plurality of second mating elements located at respective top corners of said top frame, said first and second mating elements being configured to facilitate stacking of said shipping container with similar others.

2. A combination as set forth in claim 1, further including at least one retaining band extending about said shipping container.

3. A combination as set forth in claim 1, wherein each of said first mating elements comprises a recess element and each of said second mating elements comprises a nub element, said nub element being received in said recess element.

4. A combination as set forth in claim 3, wherein each said recess element is formed by a flared cap located at a bottom of said rectangular base frame.

5. A combination as set forth in claim 1, wherein said article is secured to said base frame of said shipping container via flexible straps connected to said article.

6. A combination as set forth in claim 1, wherein said socket connections of said elongate posts and said base frame and top frame include sockets on said base frame and said top frame into which said elongate posts fit.

7. An arrangement including a pair of stacked shipping containers, each of said stacked shipping containers comprising:

a rectangular top portion having a plurality of protrusions;

a rectangular bottom portion having a plurality of mating elements;

a plurality of socket connectors, each of said socket connectors including first and second socket connector portions, one of said first and second socket connector portions of each of said socket connectors being a socket;

said rectangular top portion including a plurality of said socket connector portions;

said rectangular bottom portion including a plurality of said socket connector portions; and a plurality of intermediate portions having said socket connector portions on opposite ends thereof for connection with said socket connector portions of said rectangular top portion and said rectangular bottom portion, respectively, to form a containment volume therebetween, said protrusions of said top portion of one of said containers being received by said mating elements of said bottom portion of the other containers;

wherein said rectangular top portion of one of the pair of stacked shipping containers is adjacent to and underlies said rectangular bottom portion of another of the pair of stacked shipping containers.

8. An arrangement of claim 7, wherein said top portion, said bottom portion and said intermediate portions are formed from a plurality of tubular metal rails.

9. An arrangement of claim 7, wherein said intermediate portions comprise a first set of intermediate portions and a second set of intermediate portions, wherein each of said first set of intermediate portions have a first length different from a second length of each of said second set of intermediate portions to permit said container to be a different height between said top and bottom portions when said second set of intermediate portions are used as compared to when said first set of intermediate portions are used.

10. An arrangement of claim 7, further comprising: a support attached to said rectangular bottom portion.

11. An arrangement of claim 10, wherein said support includes support members of tubular metal rails attached to said rectangular bottom portion.

12. An arrangement of claim 7, further comprising: a connector fixedly attached to said rectangular bottom portion.

13. An arrangement having a pair of stacked shipping containers, each comprising:

a rectangular top portion having a plurality of socket connector portions and a plurality of protrusions;

a rectangular bottom portion having a plurality of socket connector portions and a plurality of mating elements and a support;

a plurality of intermediate portions connectable with said socket connector portions of said top portion and said bottom portion by socket connector portions on opposite ends of said intermediate portions to form a containment volume therebetween, said intermediate portions being provided in a plurality of lengths to permit various heights between said top and bottom portions;

said socket connector portions including one of first and second socket connector portions, wherein said first socket connector portion is a socket and said second socket connector portion is a portion received in a socket; and said protrusions of said top portion of one of said containers being received by said mating elements of said bottom portion of the other container;

wherein said rectangular top portion of one of the pair of stacked shipping containers is adjacent to and underlies said rectangular bottom portion of another of the pair of stacked shipping containers.

* * * * *